US008628354B2

(12) United States Patent
Huber et al.

(10) Patent No.: US 8,628,354 B2
(45) Date of Patent: Jan. 14, 2014

(54) ADAPTER ELEMENT FOR SERIAL DATA TRANSFER IN A VEHICLE

(75) Inventors: Martin Huber, Obing (DE); Udo Schuster, Traunwalchen (DE)

(73) Assignee: MD Elektronik GmbH, Waldkraiburg (DE)

( * ) Notice: Subject to any disclaimer, the term of this patent is extended or adjusted under 35 U.S.C. 154(b) by 0 days.

(21) Appl. No.: 13/266,004

(22) PCT Filed: Mar. 26, 2010

(86) PCT No.: PCT/EP2010/001907

§ 371 (c)(1), (2), (4) Date: Oct. 24, 2011

(87) PCT Pub. No.: WO2010/124771

PCT Pub. Date: Nov. 4, 2010

(65) Prior Publication Data

US 2012/0045943 A1 Feb. 23, 2012

(30) Foreign Application Priority Data

Apr. 29, 2009 (DE) ..... 10 2009 019 137

(51) Int. Cl.
*H01R 13/648* (2006.01)

(52) U.S. Cl.
USPC ..... 439/607.01; 439/660

(58) Field of Classification Search
USPC ..... 439/218, 607.01, 607.02, 607.4, 638, 439/660
See application file for complete search history.

(56) References Cited

U.S. PATENT DOCUMENTS

| | | | | |
|---|---|---|---|---|
| 6,948,984 | B2 * | 9/2005 | Chen et al. | 439/660 |
| 7,641,519 | B1 * | 1/2010 | Chen | 439/660 |
| 7,670,191 | B2 * | 3/2010 | Ortega et al. | 439/660 |
| 7,727,026 | B2 * | 6/2010 | Qin et al. | 439/660 |
| 7,744,426 | B2 * | 6/2010 | Zheng et al. | 439/660 |
| 7,887,373 | B1 * | 2/2011 | Wang | 439/660 |
| 8,337,253 | B2 * | 12/2012 | Gao et al. | 439/660 |
| 2008/0014797 | A1 | 1/2008 | Yang | |

FOREIGN PATENT DOCUMENTS

WO WO 2007/118562 A1 10/2007

* cited by examiner

*Primary Examiner* — Thanh Tam Le
(74) *Attorney, Agent, or Firm* — Brinks Gilson & Lione

(57) ABSTRACT

An adapter element for serial data transfer in a vehicle, the adapter element including a first housing part, which is designed electrically conductively and is connectable to a shield and a second housing part, which is designed electrically conductively and includes a contact element. The first housing part and the second housing part are disposed such that the second housing part is enclosed by the first housing part in a first region that extends along a longitudinal axis of the adapter element. The contact element is in electrical contact in the first region with the first housing part, and the contact element produces the electrical contact at least in part by the adapter element being configured such that accessibility to the contact element from a position exterior to the adapter element in a direction that is orthogonal to the longitudinal axis is ensured. In addition, the second housing part is surrounded on both sides of the first housing part by the first housing part inside a second region, which extends along the longitudinal axis.

13 Claims, 3 Drawing Sheets

ADAPTER ELEMENT FOR SERIAL DATA TRANSFER IN A VEHICLE

Applicants claim, under 35 U.S.C. §§120 and 365, the benefit of priority of the filing date of Mar. 26, 2010 of a Patent Cooperation Treaty patent application, copy attached, Serial Number PCT/EP2010/001907, filed on the aforementioned date, the entire contents of which are incorporated herein by reference, wherein Patent Cooperation Treaty patent application Serial Number PCT/EP2010/001907 was not published under PCT Article 21(2) in English.

Applicants claim, under 35 U.S.C. §119, the benefit of priority of the filing date of Apr. 29, 2009 of a German patent application, copy attached, Serial Number 10 2009 019 137.2, filed on the aforementioned date, the entire contents of which is incorporated herein by reference.

BACKGROUND OF THE INVENTION

1. Field of the Invention

The present invention relates to an adapter element, which includes two housing parts, for serial data transfer in a vehicle.

2. Description of the Related Art

Such adapter elements can be used for instance in motor vehicles or aircraft and are usually needed in large numbers. For economical production of suitable adapter elements, a simple construction and simple manufacture are of major significance. A further consideration is that such adapter elements must be well shielded electromagnetically so that no emitted electromagnetic waves can cause problems, for instance in the on-board electronics of the applicable vehicle. Moreover, problems in data transfer caused by external electromagnetic radiation in the adapter element must be avoided.

From International Patent Disclosure WO 07 118562 A1, a vehicle cable for a motor vehicle is known that has a shielded mode of construction. The associated internal housing of a plug connector is designed such that the plug connector is enclosed by a shield housing. In addition, the contact between the internal housing and the shield housing is made, for instance, by pressing the two components together.

It is also known, instead of one continuous vehicle cable, to use adapter pieces with two plug connectors.

The previously known structural forms have the disadvantage, among others, that adequate electromagnetic compatibility (EMC) is lacking particularly in high-frequency data transfers of the kind that occur at high data transfer rates.

It is therefore an object of the present invention to create an adapter element which is moreover well shielded, so that the emitted electromagnetic power is minimized, and high EMC shielding is ensured. Moreover, the adapter element should nevertheless be capable of being manufactured at a comparatively low production cost.

SUMMARY AND OBJECTS OF THE INVENTION

This object is attained according to the present invention by an adapter element for serial data transfer in a vehicle, the adapter element including a first housing part, which is designed electrically conductively and is connectable to a shield and a second housing part, which is designed electrically conductively and includes a contact element. The first housing part and the second housing part are disposed such that the second housing part is enclosed by the first housing part in a first region that extends along a longitudinal axis of the adapter element. The contact element is in electrical contact in the first region with the first housing part, and the contact element produces the electrical contact at least in part by the adapter element being configured such that accessibility to the contact element from a position exterior to the adapter element in a direction that is orthogonal to the longitudinal axis is ensured. In addition, the second housing part is surrounded on both sides of the first housing part by the first housing part inside a second region, which extends along the longitudinal axis the characteristics of claim 1.

According to the present invention, the adapter element for serial data transfer in a vehicle includes a first housing part, which is designed electrically conductively and can be connected to a shield. Furthermore, the adapter element includes a second housing part, which is likewise designed electrically conductively and has at least one contact element. The two housing parts are disposed such that the second housing part is enclosed by the first housing part in a first region, and the first region extends along the longitudinal axis of the adapter element. In this first region, the contact element is in electrical contact with the first housing part. For producing the electrical contact, the adapter element is configured such that accessibility to the contacting point from outside with a directional component that is orthogonal to the longitudinal axis is ensured. The second housing part is surrounded on both sides by the first housing part inside a further region, referred to a directional component that is orthogonal to the longitudinal axis, and the further region also extends along the longitudinal axis of the adapter element.

The first region can also be viewed as a section of the adapter element with a length in the axial direction. This section is distinguished in that in it, the second housing part is enclosed by the first housing part.

Thus, the further region represents a further standard receptacle of the adapter element, inside which the second housing part is surrounded on both sides by the first housing part, referred to a directional component that is orthogonal to the longitudinal axis, and the further portion also extends along the longitudinal axis of the adapter element.

Accordingly, inside the further region, an imaginary line, which extends from the central longitudinal axis radially outward, initially intersects the first housing part and then the second housing part and finally the first housing part again. In particular, the adapter element can be designed such that in the contacted state, a contact element is fixed on the first housing part with an axial overlap.

The first housing part can have a substantially block-shaped outer contour. Advantageously, all the outer faces of the first housing part, except for the face that is relevant for the cooperation of the plug connection elements, is at least partly enclosed by the shield housing.

Such adapter elements are as a rule needed in especially large numbers, and it is therefore advantageous that these adapter elements can be produced simply and economically. For this reason and in view of high EMC shielding, the first housing part is advantageously embodied in one piece, in particular as a cast part. In particular, the first housing part can be produced by a zinc pressure diecasting process or a metal injection molding process.

Advantageously, for producing the accessibility of the contacting point, the first housing part has a recess, which does not completely penetrate the wall of the first housing part. In in other words, the first housing is embodied as a blind bore, for instance of round or oval cross-section.

In a further embodiment of the present invention, the contact element is in electrical contact with the first housing part by a welded connection. Alternatively, a soldered connection or crimp can be made at this point. By the recess, the accessibility, for instance by a welding electrode, to the contacting point is made possible.

The emission of electromagnetic waves also depends on the geometry of the emitting body. The adapter element of the present invention is especially advantageous in the use of a universal serial bus plug connector (USB plug connector), in particular a Type A USB standard plug or USB standard receptacle.

In particular, the adapter element of the present invention can be used for an interface in accordance with the USB 2.0 standard, without having to expect difficulties with electromagnetic compatibility. Accordingly, data transfer rates of 480 Mbit/s are easily possible, even though such high data transfer rates have high voltage frequencies in the adapter element as a consequence.

Advantageously, the second housing part encloses a universal serial bus plug connector, in particular a Type A standard plug or standard receptacle.

The adapter element of the present invention is advantageous for modes of construction that have at least four wires. Accordingly, the first housing part encloses or advantageously forms a four-wire plug connector, in particular a standard plug or standard receptacle for a so-called spiral quad cable. Moreover, the first housing part can have a portion with a round cross section for connection to the shield.

The term plug connector is to be understood hereinafter to mean electrical couplings that can be embodied both as plugs and as receptacles.

Further details and advantages of the adapter element of the present invention will become apparent from the ensuing description of one exemplary embodiment in conjunction with the accompanying drawings.

DESCRIPTION OF THE PREFERRED EMBODIMENT(S) OF THE INVENTION

Figure 1:
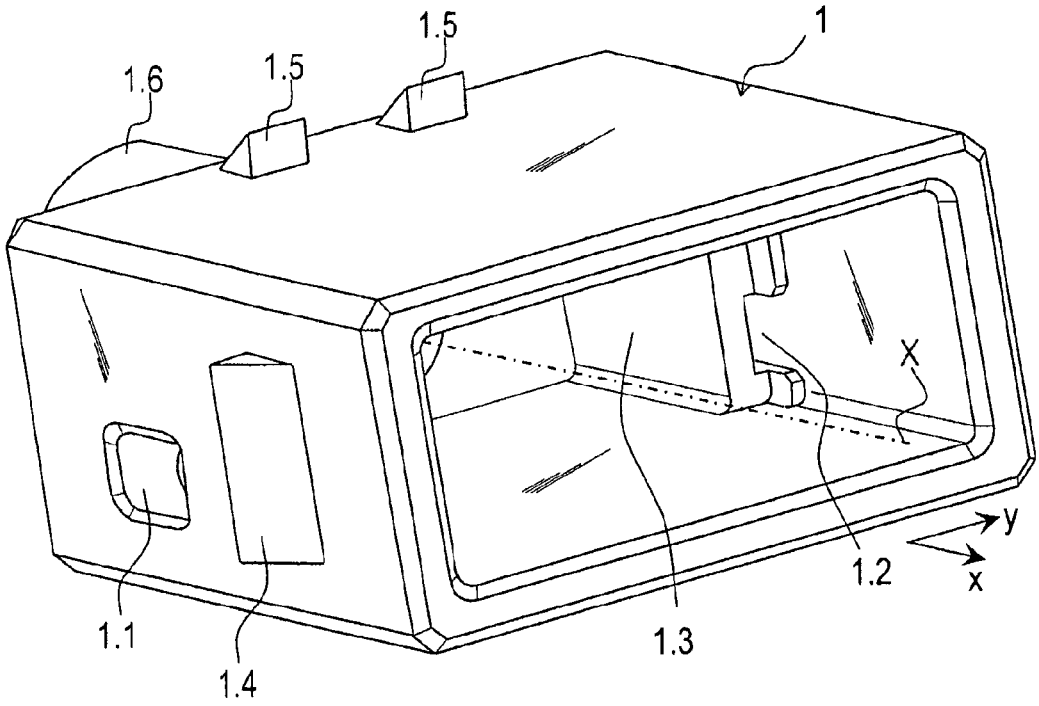
FIG. 1 is a perspective view of an embodiment of a first housing part that forms part of an adapter element in accordance with the present invention.
Figure 2:
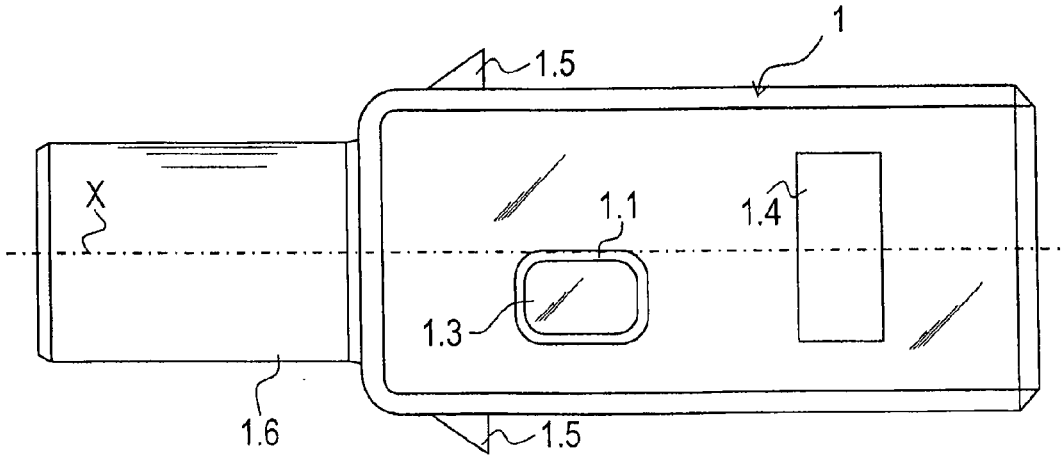
FIG. 2 is a side view on the first housing part of FIG. 1.

In FIGS. 1 and 2, a first housing part 1 of an adapter element is shown. The one-piece first housing part 1 is produced electrically conductively of a metal in the present exemplary embodiment with the aid of a so-called MIM (metal injection molding) process, which allows the economical production of comparatively complex body geometries. Moreover, the first housing part is embodied with comparatively thick walls, to minimize the electrical resistance in the first housing part 1 that is made of metal. The first housing part 1 has a longitudinal axis X, which extends parallel to the coordinate axis x. According to FIG. 1, a further coordinate axis y is then orthogonal to the coordinate axis x in space.

The first housing part 1 includes two recesses 1.1, which are disposed symmetrically relative to the longitudinal axis X and are embodied as oblong holes and are each bounded by a respective wall 1.3 in the y direction, so that the wall of the first housing part 1 is not completely penetrated in the y direction by the recesses 1.1. Moreover, in the region around the recesses 1.1, there is a respective gap 1.2 between the outer wall of the first housing part 1 and the wall 1.3. In this way, a closed chamber around the longitudinal axis X is created in the first housing part 1. Because of the respective offset of the wall 1.3 relative to the recess 1.1, there is no through opening in the first housing part 1. Because of this special disposition, despite the recesses 1.1, "sight tightness" in the y direction exists for the first housing part 1. One of ordinary skill would understand this to mean that in the present case "sight tightness" exists because despite the fact that recesses 1.1 exist, it is not possible to see in the inner space of first housing part 1 when viewed in the y-direction. Moreover, the first housing part 1 has detent lugs 1.4, 1.5 for lockable connection of the first housing part 1 to an HSD (high speed data) plug element, not shown in the drawings. Moreover, the first housing part 1 has a hollow-cylindrical end piece 1.6, which can be connected to a shield that is embodied, for example, as a cable mesh of a spiral quad cable.

Figure 3:
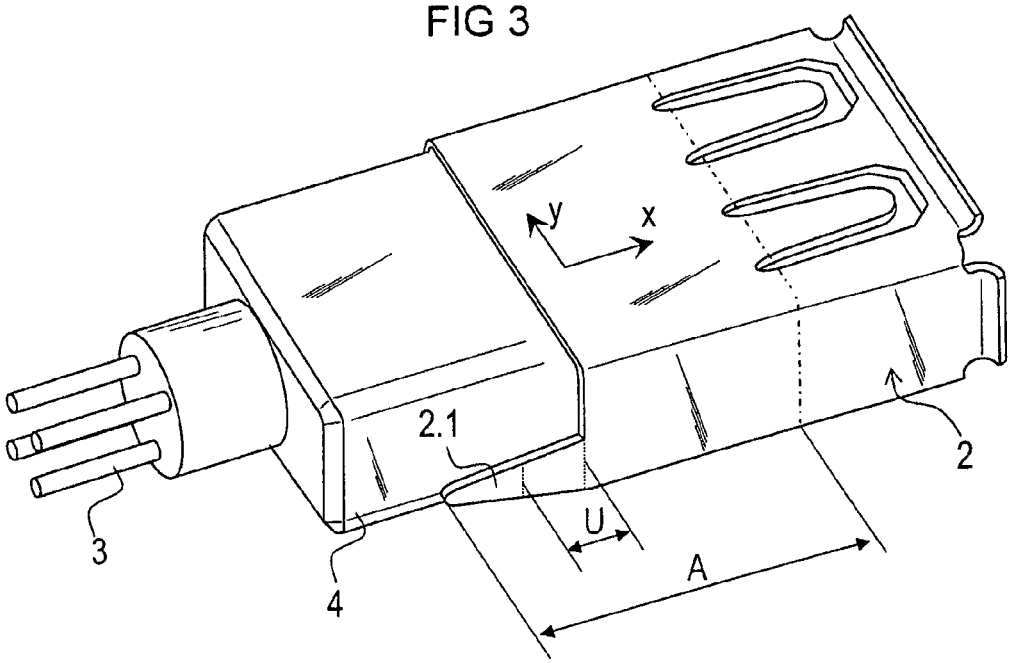
FIG. 3 is a perspective view of an embodiment of a second housing part that forms part of an adapter element in accordance with the present invention.

In FIG. 3, a second housing part 2, which has been produced by a stamping and bending process, has a contact element 2.1, which is designed as a tab of the one-piece second housing part 2. Like the first housing part 1, the second housing part 2 is also made of metal and thus, is electrically conductive. The second housing part 2, in the exemplary embodiment presented here, serves to receive a plug connector, in this case in the form of a flat, essentially block-shaped Type A USB receptacle. Also disposed on the second housing part 2 is an insulator element 4, in which four inner conductors 3 extend, whose ends protrude out of the insulator element 4 and serve as plug prongs. The other ends, arranged in a row, of the inner conductors 3 are welded inside the second housing part 2 in the USB receptacle and are not visible in FIG. 3.

Figure 4:
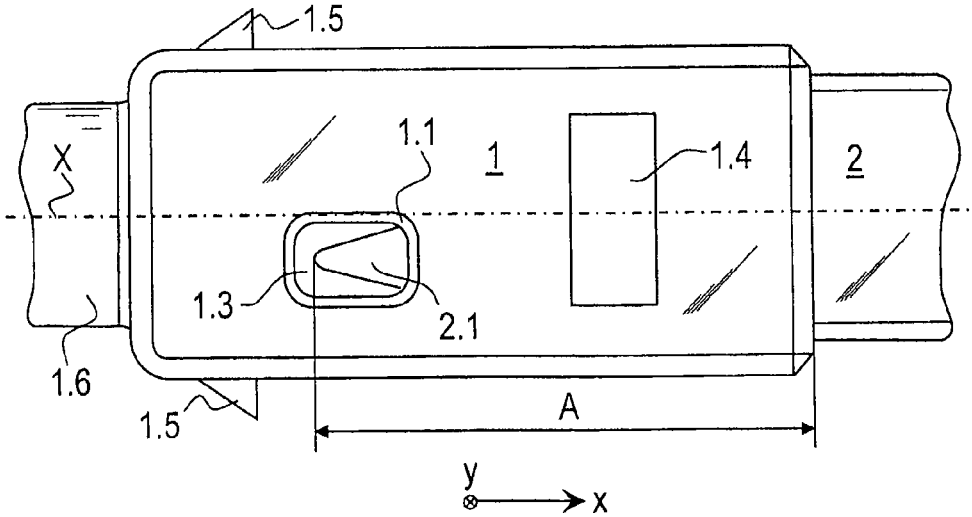
FIG. 4 is a side view of an embodiment of an adapter element that is formed by the first and second housing parts of FIGS. 1-3 in accordance with the present invention.

In the course of assembly, the first housing part 1 is slipped over the second housing part 2 (arriving from the left in terms of FIG. 3), until the insulator element 4 strikes the bottom of the first housing part 1, so that in a region A of the first housing part 1 the second housing part 2 is enclosed by the first housing part 1. The region A extends along the longitudinal axis X of the adapter element; that is, the region A has an axial length, corresponding to the arrow for identifying the region A in FIG. 3. The two housing parts 1, 2 are dimensioned with a precise fit, so that no air gap is created at the boundary of the overlap. When the two housing parts 1, 2 are put together, the two contact elements 2.1 are each guided by the gap 1.2. As shown in FIG. 4, each contact element 2.1 is constructed so that when inserted into gap 1.2, the contact element 2.1 is positioned between the wall 1.3 and the recess 1.1. The ends of the inner conductors 3 are located inside the end piece 1.6, so that the latter can serve as part of a plug connector.

In FIG. 4, the adapter element, which serves the purpose of serial data transfer in a vehicle, is shown after assembly of the two housing parts 1, 2 has been completed. The contact elements 2.1 are accessible from outside through the recesses 1.1 in the region A, or in other words from the y direction or toward the y direction (±y direction) for the production of a good electrical contact. Moreover, the second housing part 2 is enclosed on both sides of the first housing part 1 by the first housing part 1 inside a further region U (see also FIG. 5). The term "on both sides" refers to the direction y, which is oriented orthogonally to the longitudinal axis X. Accordingly, the second housing part 2 is surrounded on both sides in a y direction in the region U by the first housing part 1, and adjacently on the inside, the respective wall 1.3 can be seen from outside.

Figure 5:
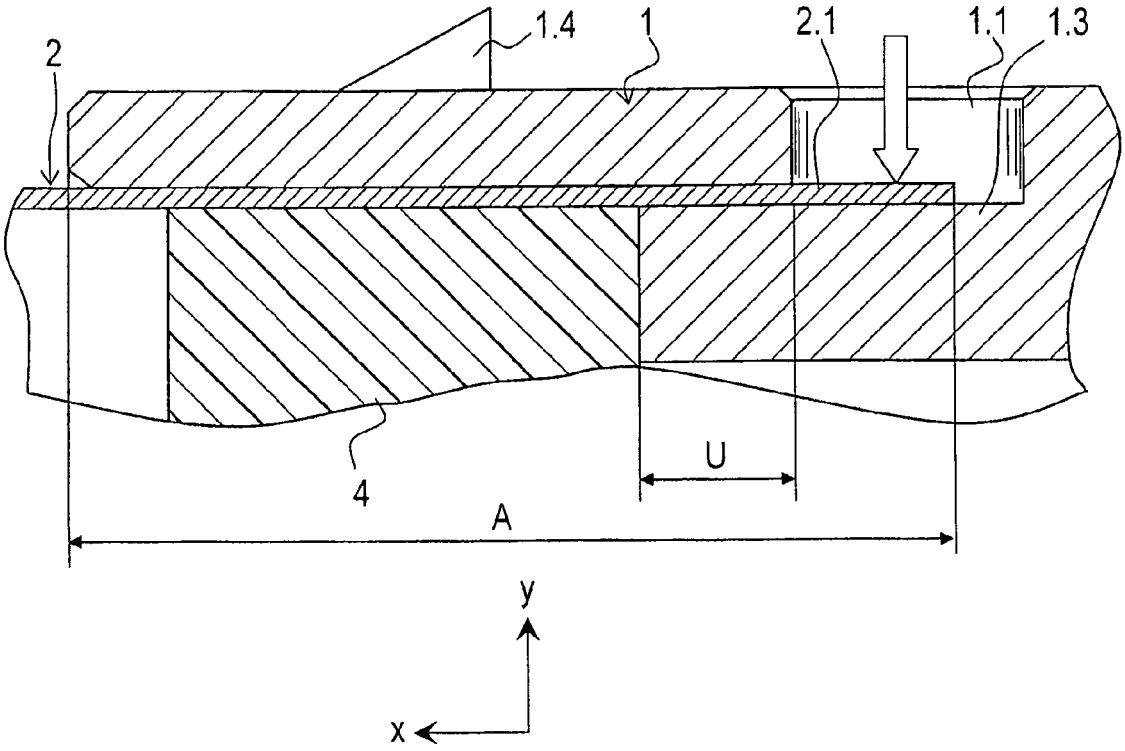
FIG. 5 is a fragmentary sectional view through the contacting region of the adapter element of FIG. 4.

In this assembled arrangement, the contact elements 2.1 can now be permanently connected to the walls 1.3 by a spot weld, so that excellent electrical contact between the housing parts 1, 2 is achieved. In FIG. 5, a welding electrode is shown schematically as a vertical arrow inside the recess 1.1.

As a result of the special construction, in which the first housing part 1 and the second housing part 2 overlap in the region U, a quasi-labyrinthine effect for electromagnetic waves is attained, so that the adapter element attains excellent EMC shielding.

In operation of the adapter element, a corresponding counterpart piece is attached to the end piece 1.6 acting as a plug connector of a spiral quad cable, so that the four ends of the inner conductors 3 are in contact with the corresponding wires of the spiral quad cable. Two of the wires are intended for transferring data. The other two wires are intended during operation of the adapter element to supply a device, connected to the universal serial bus plug connector, with a voltage of 5 V. The four wires are surrounded in the spiral quad cable by a shield. This shield is in electrical contact with the end piece 1.6, so that during operation of the adapter element, the shield potential is applied to the first housing part 1. Because of the electrical contact of the first housing part 1 and the second housing part 2 with the aid of the welded connection described above, the second housing part 2 is also connected securely and reliably to the shield potential.

Because of the high data transfer rates, such as 480 Mbit/s, high voltage frequencies occur in the adapter element, on the order of magnitude of 40 MHz, for instance. It has now been demonstrated that a corresponding adapter element of conventional design causes comparatively high emission levels in operation. In particular, the high emission levels can cause problems in the on-board electronics; such problems must be avoided under all circumstances, especially with regard to safety-relevant functions of the on-board electronics. By of the adapter element of the invention, electromagnetic incompatibility of a USB interface in a vehicle is precluded.

Further embodiment variations of the method and devices in accordance with the present invention of course exist besides the explained examples and embodiments.

We claim:

1. An adapter element for serial data transfer in a vehicle, the adapter element comprising:

a first housing part, which is designed electrically conductively and is connectable to a shield, wherein said first housing part extends along a longitudinal axis of said adapter element; and a planar second housing part, which is designed electrically conductively and comprises a contact element, wherein said first housing part and said second housing part are disposed such that said second housing part is enclosed by said first housing part in a first region that extends along said longitudinal axis of said adapter element;

wherein said contact element is in electrical contact in said first region with said first housing part, and said contact element produces said electrical contact at least in part by said adapter element being configured such that accessibility to said contact element from a position exterior to said adapter element in a direction that is orthogonal to said longitudinal axis is ensured;

wherein, at a second region that extends along said longitudinal axis of said adapter element, said second housing part is surrounded by a first side of said first housing part and a second side of said first housing part, wherein said first side of said first housing part is spaced from said second side of said first housing part along said direction orthogonal to said longitudinal axis and wherein said planar second housing part fits between and contacts said first side of said first housing part and said second side of said first housing part; and wherein said first housing part defines a recess that produces accessibility of said contact element and a wall comprises an outer wall, an inner wall and a gap located between said outer wall and said inner wall so that said recess does not completely penetrate said wall of said first housing part and said contact element located between said recess and said inner wall.

2. The adapter element as defined by claim 1, wherein said first housing part is embodied in one piece.

3. The adapter element as defined by claim 2, wherein said first housing part is a cast part.

4. The adapter element as defined by claim 1, wherein said first housing part is produced by a zinc pressure diecasting process.

5. The adapter element as defined by claim 1, wherein said first housing part is produced by a metal injection molding process.

6. The adapter element as defined by claim 1, wherein said second housing part encloses a universal serial bus plug connector.

7. The adapter element as defined by claim 6, wherein said universal serial bus plug connector is selected from the group consisting of a Type A standard plug and a standard receptacle.

8. The adapter element as defined by claim 1, wherein said first housing part comprises a portion with a round cross section for connection to said shield.

9. An adapter element for serial data transfer in a vehicle, the adapter element comprising:

a first housing part, which is designed electrically conductively and is connectable to a shield, wherein said first housing part extends along a longitudinal axis of said adapter element; and a second housing part, which is designed electrically conductively and comprises a contact element, wherein said contact element is in electrical contact with said first housing part via a welded connection, and wherein said first housing part and said second housing part are disposed such that said second housing part is enclosed by said first housing part in a first region that extends along said longitudinal axis of said adapter element;

wherein said contact element is in electrical contact in said first region with said first housing part, and said contact element produces said electrical contact at least in part by said adapter element being configured such that accessibility to said contact element from a position exterior to said adapter element in a direction that is orthogonal to said longitudinal axis is ensured;

wherein, at a second region that extends along said longitudinal axis of said adapter element, said second housing part is surrounded by a first side of said first housing part and a second side of said first housing part, wherein said first side of said first housing part is spaced from said second side of said first housing part along said direction orthogonal to said longitudinal axis; and wherein said first housing part defines a recess that produces accessibility of said contact element and a wall comprises an outer wall, an inner wall and a gap located between said outer wall and said inner wall so that said recess does not completely penetrate said wall of said first housing part and said contact element located between said recess and said inner wall.

10. The adapter element as defined by claim 9, wherein said second housing part is planar, and wherein said planar second housing part fits between and contacts said first side of said first housing part and said second side of said first housing part.

11. An adapter element for serial data transfer in a vehicle, the adapter element comprising:

a first housing part, which is designed electrically conductively and is connectable to a shield, wherein said first housing part encloses a four-wire plug connector, and wherein said first housing part extends along a longitudinal axis of said adapter element; and a second housing part, which is designed electrically conductively and comprises a contact element, wherein said first housing part and said second housing part are disposed such that said second housing part is enclosed by said first housing part in a first region that extends along said longitudinal axis of said adapter element;

wherein said contact element is in electrical contact in said first region with said first housing part, and said contact element produces said electrical contact at least in part by said adapter element being configured such that accessibility to said contact element from a position exterior to said adapter element in a direction that is orthogonal to said longitudinal axis is ensured;

wherein at a second region that extends along said longitudinal axis of said adapter element, said second housing part is surrounded by a first side of said first housing part and a second side of said first housing part, wherein said first side of said first housing part is spaced from said second side of said first housing part along said direction orthogonal to said longitudinal axis; and wherein said first housing part defines a recess that produces accessibility of said contact element and a wall comprises an outer wall, an inner wall and a gap located between said outer wall and said inner wall so that said recess does not completely penetrate said wall of said first housing part and said contact element located between said recess and said inner wall.

12. The adapter element as defined in claim 11, wherein said four-wire plug connector is selected from the group consisting of a standard plug and standard receptacle for a spiral quad cable.

13. The adapter element as defined by claim 11, wherein said second housing part is planar, and wherein said planar second housing part fits between and contacts said first side of said first housing part and said second side of said first housing part.

* * * * *